US006971542B2

(12) United States Patent
Vogel et al.

(10) Patent No.: US 6,971,542 B2
(45) Date of Patent: Dec. 6, 2005

(54) REACH-IN WIPES WITH ENHANCED DISPENSIBILITY

(75) Inventors: Nathan John Vogel, Sturgeon Bay, WI (US); Kenneth Bradley Close, New London, WI (US); Brian Chun-Keet Kwok, Neenah, WI (US); Yung Hsiang Huang, Appleton, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 385 days.

(21) Appl. No.: 10/318,808

(22) Filed: Dec. 13, 2002

(65) Prior Publication Data

US 2004/0115393 A1 Jun. 17, 2004

(51) Int. Cl.[7] ..... A47K 10/24
(52) U.S. Cl. ..... 221/45; 206/494
(58) Field of Search ..... 221/33, 45, 47, 221/48, 63, 303, 305; 206/494, 449, 812, 554

(56) References Cited

U.S. PATENT DOCUMENTS

| | | | |
|---|---|---|---|
| 2,118,380 | A | 5/1938 | Gresenz |
| 2,323,395 | A | 7/1943 | Harwood |
| 2,502,772 | A | 4/1950 | Winstead |
| 2,529,853 | A | 11/1950 | Taggart |
| 2,626,145 | A | 1/1953 | Sabee |
| 2,761,677 | A | 9/1956 | Rutkus et al. |
| 2,809,082 | A | 10/1957 | Marcuse |
| 2,823,089 | A | 2/1958 | De Franco |
| 2,890,791 | A | 6/1959 | Wenzel |
| 3,007,605 | A | 11/1961 | Donovan |
| 3,021,002 | A | 2/1962 | Guyer |
| 3,160,337 | A | 12/1964 | Nelson |
| 3,161,336 | A | 12/1964 | Loescher |
| 3,172,563 | A | 3/1965 | Harwood |
| 3,239,097 | A | 3/1966 | Bates et al. |
| 3,266,666 | A | 8/1966 | Nelson |
| 3,369,699 | A | 2/1968 | Enloe et al. |
| 3,490,645 | A | 1/1970 | Glass et al. |
| 3,576,243 | A | 4/1971 | Trunick |
| 3,679,094 | A | 7/1972 | Nissen et al. |
| 3,679,095 | A | 7/1972 | Nissen et al. |
| 3,700,138 | A | 10/1972 | Nelson |
| 3,749,296 | A | 7/1973 | Harrison |
| 3,780,908 | A | 12/1973 | Fitzpatrick et al. |
| 3,795,355 | A | 3/1974 | Gerstein |
| 3,805,474 | A | 4/1974 | Gerstein |
| 3,836,044 | A | 9/1974 | Tilp et al. |

(Continued)

FOREIGN PATENT DOCUMENTS

| | | |
|---|---|---|
| CA | 996515 | 9/1976 |
| EP | 0 223 262 A2 | 5/1987 |
| EP | 0 286 538 B1 | 1/1992 |
| EP | 0 857 453 A1 | 8/1998 |
| EP | 1 023 863 A1 | 8/2000 |
| WO | WO 00/44270 A1 | 8/2000 |
| WO | WO 02/053365 A2 | 7/2002 |
| WO | WO 02/053368 A2 | 7/2002 |

*Primary Examiner*—Kenneth Noland
(74) *Attorney, Agent, or Firm*—Michael J. Hendel; Scott A. Baum

(57) ABSTRACT

The invention relates to a stack of wipes for use in a reach-in wipes dispenser having a dispensing opening, and related method. The stack includes a plurality of wipes stacked upon each other. Each wipe is separably joined to an adjacent wipe to form a joint therebetween. For at least 50% of the wipes in the stack of wipes, dispensing a top wipe from the stack of wipes causes an adjacent following wipe to at least partially be drawn upwards towards and/or through the dispensing opening, and the top wipe completely separates automatically from the following wipe at the joint before the following wipe completely passes through the dispensing opening, and when the top wipe completely separates automatically from the following wipe the following wipe falls back towards the stack of wipes and is positioned within the dispenser and below the dispensing opening.

28 Claims, 6 Drawing Sheets

U.S. PATENT DOCUMENTS 3,843,017 A 10/1974 Harrison
3,868,052 A 2/1975 Rockefeller
3,881,632 A 5/1975 Early et al.
3,894,898 A 7/1975 Taylor
3,973,695 A 8/1976 Ames
4,002,264 A 1/1977 Marchesani
4,009,682 A 3/1977 Patel et al.
4,017,002 A 4/1977 Doyle et al.
4,064,880 A 12/1977 Logan
4,100,324 A 7/1978 Anderson et al.
4,101,026 A 7/1978 Bonk
4,166,551 A 9/1979 Stiros
4,191,609 A 3/1980 Trokhan
4,200,200 A 4/1980 Hein, III et al.
4,219,129 A 8/1980 Sedgwick
4,244,493 A 1/1981 Harrison
4,262,816 A 4/1981 Margulies
4,328,655 A 5/1982 Spencer et al.
4,328,907 A 5/1982 Beard
4,416,392 A 11/1983 Smith
4,450,026 A 5/1984 Pieniak et al.
4,458,810 A 7/1984 Mahoney
4,475,881 A 10/1984 Borst et al.
4,534,491 A 8/1985 Norton et al.
4,574,952 A 3/1986 Masui
4,611,728 A 9/1986 Compton et al.
4,623,074 A 11/1986 Dearwester
4,638,921 A 1/1987 Sigl et al.
4,653,666 A 3/1987 Mertens
4,674,634 A * 6/1987 Wilson ..... 206/554
4,681,240 A 7/1987 Wyant
4,720,415 A 1/1988 Vander Wielen et al.
4,741,944 A 5/1988 Jackson et al.
4,768,810 A 9/1988 Mertens
4,776,649 A 10/1988 ten Wolde
4,778,048 A 10/1988 Kaspar et al.
4,781,306 A 11/1988 Smith
4,859,518 A 8/1989 Schutz
4,863,064 A 9/1989 Dailey, III
4,865,221 A 9/1989 Jackson et al.
4,895,746 A 1/1990 Mertens
4,921,127 A 5/1990 Windorski
4,927,064 A 5/1990 Burgin
4,952,432 A 8/1990 Ten Wolde
4,986,440 A 1/1991 Windorski
4,993,590 A 2/1991 Windorski
5,033,620 A 7/1991 De Luca
5,050,909 A 9/1991 Mertens et al.
5,067,628 A 11/1991 Evenson
5,076,424 A 12/1991 Nakamura
5,080,254 A 1/1992 Feer
5,080,255 A 1/1992 Windorski
5,118,554 A 6/1992 Chan et al.
5,152,121 A 10/1992 Nakamura
5,158,205 A 10/1992 Bodziak et al.
5,165,570 A 11/1992 Windorski et al.
5,167,346 A 12/1992 Bodziak
5,316,177 A 5/1994 Boldt
5,332,118 A 7/1994 Muckenfuhs
5,350,597 A 9/1994 Pelley
5,358,140 A 10/1994 Pellegrino
5,379,897 A 1/1995 Muckenfuhs et al.
5,385,775 A 1/1995 Wright
5,508,102 A 4/1996 Georger et al.
5,516,001 A 5/1996 Muckenfuhs et al.
5,520,308 A 5/1996 Berg, Jr. et al.
5,540,332 A 7/1996 Kopacz et al.
5,642,835 A 7/1997 Young et al.
5,647,506 A 7/1997 Julius
5,810,200 A 9/1998 Trokhan
5,891,008 A 4/1999 Bavely et al.
5,899,447 A 5/1999 Muckenfuhs
6,082,663 A 7/2000 Tramontina et al.
2002/0127937 A1 9/2002 Lange et al.
2002/0192433 A1 12/2002 Huang et al.
2002/0195764 A1 12/2002 Sosalla
2003/0022781 A1 1/2003 Sosalla et al.

* cited by examiner

REACH-IN WIPES WITH ENHANCED DISPENSIBILITY

BACKGROUND OF THE INVENTION

Wipes have been made from a variety of materials which can be dry or wet when used. Perhaps the most common form of wipes has been a stack of moistened sheets which have been packaged in a plastic container and are known as wet wipes. Typically, the wipes have had linear (e.g., straight) or non-linear (e.g., curved or zigzagged) edges and a generally rectangular to square configurations. The wipes have also been available in either folded or unfolded configurations. For example, stacks of wipes have been available wherein each of the wipes in the stack have been arranged in a folded configuration such as a c-folded, z-folded or quarter-folded configuration, as are well known to those skilled in the art. Each folded wipe can be interfolded with the wipes immediately above and below in the stack of wipes. Such wipes have been formed as discrete wipes that are separate from one another upon formation into a stack of wipes and are intended to not interact with one another upon dispensing. In addition, the wipes have been in the form of continuous webs of material which include perforations to separate the individual wipes and which are wound into rolls and packaged in plastic is containers. Such wipes have been used for baby wipes, hand wipes, household cleaning wipes, industrial wipes and the like. The wet wipes have been made from a variety of materials and are moistened with a suitable wiping solution.

The conventional packages which contain stacks of wipes, such as those described above, have been designed to provide one at a time dispensing which can be accomplished using a single hand. Such single handed, one at a time dispensing is particularly desirable because the other hand of the user is typically required to be simultaneously used for other functions. For example, when changing a diaper product on an infant, the user typically uses one hand to hold and maintain the infant in a desired position while the other hand is searching for a wet wipe, such as a baby wipe, to clean the infant.

However, the dispensing of wipes in such stacks has not been completely satisfactory. For example, users of the wipes have had difficulties recognizing and grasping the edges of each individual wipe to dispense or remove the wet wipe from the package. This problem has been particularly acute when the individual wipes in the stack are folded such that the leading edge of each wipe is folded over upon another portion of the wipe. Typically, the user will frictionally drag from one to three fingers across the top surface of the stack of wet wipes in an attempt to peelingly lift the leading end edge of the top wipe from the stack of wipes. However, the leading end edge of each wipe in such a folded configuration has tended to have an affinity for the other portions of the wipe, especially when the wipes have been arranged in a stacked configuration for a period of time, and/or when the wipes are wet wipes due to adhesion caused by the moistening solution. As a result, in use, it has been undesirably difficult for the user to peelingly lift the leading end edge of each wipe from the other portions of the wipe to facilitate the dispensing of each wipe from the stack of wet wipes.

Moreover, as each wipe in the stack of wipes has been dispensed or removed from the stack, the trailing edge portion of the wipe has not always easily separated from the adjacent middle portion of the wipe. Such difficult separation has undesirably caused the user to exert additional force to unfold the wipe to gain full access to its surface area for wiping. Still additionally, in packages which contain a stack of individually folded wipes, each wipe has not always completely unfolded as it has been removed from the stack by the user. For example, various flap portions of the individually folded wipe have undesirably remained in a contacting relationship with the other portions of the wipe as the wipe has been removed. Such difficult separation and incomplete unfolding has undesirably resulted in reduced consumer acceptance. Without being limited to a theory of understanding, this is believe to occur because such existing wipes are intended to not interact with one another upon dispensing.

The difficulties encountered in dispensing the wipes has been particularly evident in stacks of wipes which have a solution add-on (i.e., wet wipes, and particularly wipes with greater solution add-on) and in stacks of wipes which have a greater number of wipes. For example, each wet wipe and, in particular, the edges of each wet wipe, have had an increased affinity for the other portions of the wet wipe and the adjacent wet wipe in the stack as the amount of solution in the stack increases. As a result, the consistency and reliability of the dispensing of such wet wipes has undesirably declined as the amount of solution has increased. Accordingly, it has been desired to provide a wipe and stack of wipes, each in a reach-in format, which have enhanced dispensability, particularly for wet wipes.

SUMMARY OF THE INVENTION

In response to the difficulties and problems discussed above, for example, a new relationship between two adjacent wipes enabling enhanced dispensing, and which may be more cost effective and reliable (e.g., reducing the likelihood of difficult wipe location and dispensing), has been developed. For example, dispensing can be enhanced or made easier when at least a leading portion of a wipe is ready for dispensing upon the opening of a resealable wipes dispenser after the initial opening of the dispenser and use of a first wipe in a plurality of wipes. That is, a leading edge of the top wipe can be more constantly positioned relative to the stack of wipes sufficiently extended upward so a user can readily find and grasp the edge and remove the entire individual wipe. Alternatively, dispensing can be made easier by mere loosening of the leading edge of the succeeding wipe to lessen the inherent adhesion force between the leading edge and the middle portion of the succeeding wipe. As another example, multiple wipes dispensing can occur when a leading individual wipe in a plurality of wipes does not timely separate completely from a following individual wipe at a joint between the adjacent wipes, i.e., before the leading wipe completely passes though the dispensing opening or orifice so that the following wipe falls back into the dispenser and remains at least partial separably joined to its following wipe in the stack of wipes for next dispensing. This can be desirable when two (or more) wipes are needed, but if only one is desired, then this is not preferred. As yet another example, dispensing can be enhanced or made easier when a folded wipe is readily extended to full length merely through the dispensing motion of a wipe because of the relationship with the following wipe. Additional features of the invention will be realized and attained by the product and processes particularly pointed out in the written description and claims hereof, as well as from the appended drawings. The purposes and features of the present invention will be set forth in and are apparent from the description that follows, as well as will be learned by practice of the invention.

In one aspect, the invention provides a stack of wipes for use in a reach-in wipes dispenser having a dispensing opening. The stack includes a plurality of wipes stacked upon each other. Each wipe is separably joined to an adjacent wipe to form a joint therebetween. For at least 50% of the wipes in the stack of wipes, dispensing a top wipe from the stack of wipes causes an adjacent following wipe to at least partially be drawn upwards towards and/or through the dispensing opening, and the top wipe completely separates automatically from the following wipe at the joint before the following wipe completely passes through the dispensing opening, and when the top wipe completely separates automatically from the following wipe the following wipe falls back towards the stack of wipes and is positioned within the dispenser and below the dispensing opening.

In another aspect, the invention provides a stack of wipes for use in a resealable reach-in wipes dispenser having a dispensing opening. The stack includes a plurality of wipes stacked upon each other. Each wipe of the plurality of wipes is separably joined to an adjacent wipe to form a joint therebetween, and each wipe is folded upon itself at least once forming a leading portion of the wipe before a first fold and a trailing portion of the wipe after a last fold. For at least 50% of the wipes in the stack of wipes, dispensing a top wipe from the stack of wipes causes an adjacent following wipe to at least partially be drawn upwards towards and/or through the dispensing opening, and the top wipe completely separates automatically from the following wipe at the joint before the following wipe completely passes through the dispensing opening, and when the top wipe completely separates automatically from the following wipe the following wipe falls back towards the stack of wipes and is positioned within the dispenser and below the dispensing opening. And, for at least 50% of the wipes in the stack of wipes, the leading portion of the following wipe stays below the dispensing opening during the time when the top wipe is being dispensed and until the top wipe is completely separated automatically from the following wipe and the following wipe then becomes the top wipe in the stack of wipes.

In other aspects, the invention provides a method for dispensing a stack of wet wipes from a resealable reach-in wipes dispenser having a dispensing opening. The is method includes the following steps: unsealing the reach-in wipes dispenser to gain access to a plurality of wipes stacked upon each other to form the stack of wipes, each wipe in the stack of wipes folded upon itself at least once and each wipe separably joined to an adjacent wipe to form a joint therebetween and each wipe being a wet wipe; locating a leading portion of a top wipe and withdrawing the leading portion through the dispensing opening; at least partially unfolding the top wipe as the leading portion is withdrawn through the dispensing opening; for at least 50% of the wipes in the stack of wipes, drawing upwards at least a portion of the following wipe towards and/or through the dispensing opening wherein the top wipe completely separates automatically from the following wipe at the joint before the following wipe completely passes through the dispensing opening such that when the top wipe completely separates automatically from the following wipe the following wipe falls back towards the stack of wipes and is positioned within the dispenser and below the dispensing opening; and sealing the reach-in wipes dispenser.

In yet other aspects, the invention provides various configurations for the separably joined relationship, the wipes per se, and the wipes relative to other wipes such as in a stack of wipes, as well as, for use of wipes of the invention in various types of dispensers, e.g., rigid to non-rigid, and for dispensing in various manners and wipe positions and with dry to wet wipes.

A variety of definitions used throughout the specification are provided first, followed by a further description of aspects of the invention.

Definitions

As used herein, "automatically" means that separation at the joint between adjacent wipes occurs as a result of the configuration and relationship of the wipes in the stack of wipes in response to the act of dispensing a top wipe from the stack of wipes. That is, external forces provided beyond the wipes in the stack of wipes, such as a user's second hand or a restrictive orifice of the dispenser to act upon the succeeding wipe(s), are not needed to separate the wipes of the invention.

As used herein, wipes of the invention are considered "separably joined", "separably joining" (and variations thereof) when each wipe of a plurality, e.g., in a stack of wipes, is engaging any adjacent wipe while in the dispenser or package such that withdrawing the leading wipe through the dispenser or package opening also separates at least a portion of the following wipe from itself or portion of a succeeding wipe immediately below the portion of the following wipe being caused to separate by the leading wipe. Such engaging of any adjacent wipe can include an interfolded relationship or a non-interfolded relationship in combination with one or more of the following between adjacent wipes: adhesive, friction, fusion bonding (e.g., ultrasonic welding, heat sealing), mechanical entanglement (e.g., needle punching, steam sealing, embossing, crimping), autogeneous bonding, and/or weakened line(s) (e.g., perforations, zones of frangibility, score line(s), crush cutting).

As used herein, when the following wipe that has at least a portion through the opening of the dispenser or package is intentionally maintained in the opening after the leading wipe is completely separated from the following wipe, this is referred to as "pop-up" format or dispensing. To be intentionally maintained in the opening means the opening is configured to maintain the wipe in the opening between successive dispensing occasions, such as through use of a constricting orifice or opening being smaller than the wipe in at least one dimension of the wipe.

As used herein, "reach-in" dispensing is understood to mean having to fetch a wipe out of a dispenser through an opening substantially coextensive with the walls of the dispenser or through a restricted opening smaller than the perimeter defined by the walls. In either case, the top wipe for dispensing rests on top of the remainder of the stack of wipes and is not in a pop-up position but rather the top wipe needs to be retrieved from the remainder of the stack each time anew when dispensing is desired. An example of a reach-in dispenser is found in the currently available baby wipes product sold by Kimberly-Clark Corporation of Neenah, Wis. under the trade name HUGGIES® Supreme Care.

As used herein, the term "wet wipe" refers to a fibrous sheet that has a liquid applied thereto during manufacture. The amount of liquid or solution contained within each wet wipe can vary depending upon the type of material being used to provide the wet wipe, the type of liquid being used, the type of container being used to store the stack of wet wipes, and the desired end use of the wet wipe. Generally, each wet wipe can contain from about 25 to about 700 weight percent or from about 200 to about 400 weight percent liquid based on the dry weight of the wipe, for improved wiping in certain situations. To determine the liquid add-on, first the weight of a just-manufactured dry wipe is determined. Then, the amount of liquid by weight equal to the weight of the just-manufactured dry wipe, or an increased amount of liquid measured as a percent add-on based on the weight of the just-manufactured dry wipe, is added to the wipe to make it moistened, and then known as a "wet wipe" or "wet wipes". The liquid may include a fragrance and/or an emollient and may serve to aid the fibrous sheet in retention of materials, which are to be wiped up during its utilization.

As used herein, the term "nonwoven web" means a structure or a web of material that has been formed without use of traditional fabric forming processes, such as weaving or knitting, to produce a structure of individual fibers or threads that are intermeshed, but not in an identifiable, repeating manner. Non-woven webs have been, in the past, formed by a variety of conventional processes such as, for example, meltblowing processes, spunbonding processes, film aperturing processes and staple fiber carding processes.

As used herein, the term "coform" means a nonwoven composite material of air-formed matrix material comprising thermoplastic polymeric meltblown fibers such as, for example, microfibers having an average fiber diameter of less than about 10 microns, and a multiplicity of individualized absorbent fibers such as, for example, wood pulp fibers disposed throughout the matrix of polymer microfibers and engaging at least some of the microfibers to space the microfibers apart from each other. The absorbent fibers are interconnected by and held captive within the matrix of microfibers by mechanical entanglement of the microfibers with the absorbent fibers, the mechanical entanglement and interconnection of the microfibers and absorbent fibers alone form a coherent integrated fibrous structure. The coherent integrated fibrous structure can be formed by the microfibers and wood pulp fibers without any adhesive, molecular or hydrogen bonds between the two different types of fibers. The absorbent fibers are preferably distributed uniformly throughout the matrix of microfibers to provide a homogeneous material. These materials are prepared according to the descriptions in U.S. Pat. No. 4,100,324 to Anderson et al. ("Anderson"), U.S. Pat. No. 5,508,102 to Georger et al. ("Georger") and U.S. Pat. No. 5,385,775 to Wright ("Wright"), as well as related teaching in U.S. patent application Ser. No. 09/751,329, entitled "Composite Material With Cloth-Like Feel", filed Dec. 29, 2000 and U.S. patent application Ser. No. 10/032,703, entitled "Method And Apparatus For Controlling Retraction Of Composite Materials", filed Dec. 28, 2001, all assigned to the same Assignee as in the present invention.

It is to be understood that both the foregoing general description and the following detailed description are exemplary and are intended to provide further explanation of the invention claimed. The accompanying drawings, which are incorporated in and constitute part of this specification, are included to illustrate and provide a further understanding of the wipes of the invention.

BRIEF DESCRIPTION OF THE DRAWINGS

The drawings are merely representative and are not intended to limit the scope of the claims. Like parts depicted in the drawings are referred to by the same reference numerals.

DETAILED DESCRIPTION OF THE INVENTION

Figure 1A:
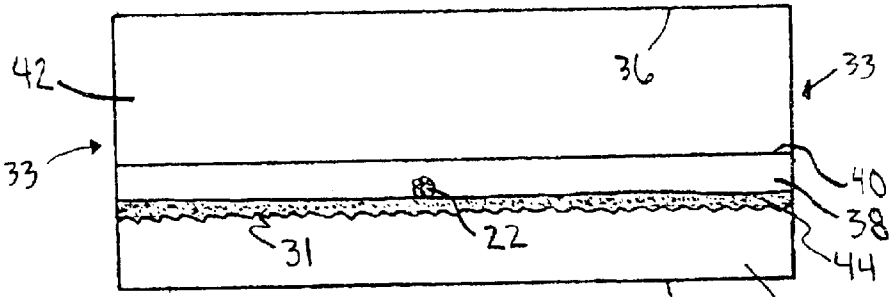
FIG. 1A shows a top view of the following wipe seen in FIG. 1, taken along the line A—A.
Figure 4:
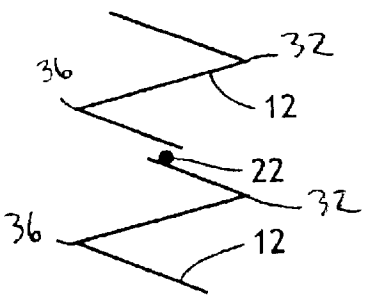
FIGS. 2–6 are similar to FIG. 1 but representatively show alternative configurations for separably joining together a plurality of wipes.
Figure 3:
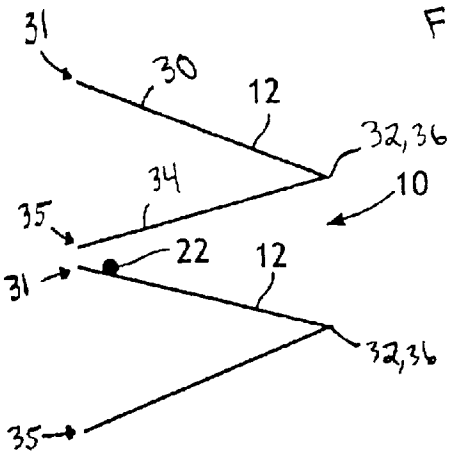
Figure 1:
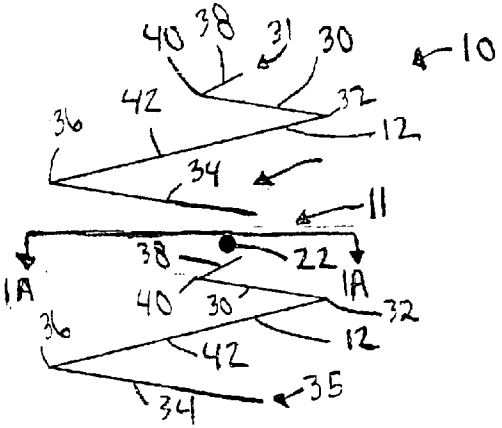
FIG. 1 representatively shows a schematic side view for a plurality of wipes about to be separably joined together.
Figure 2:
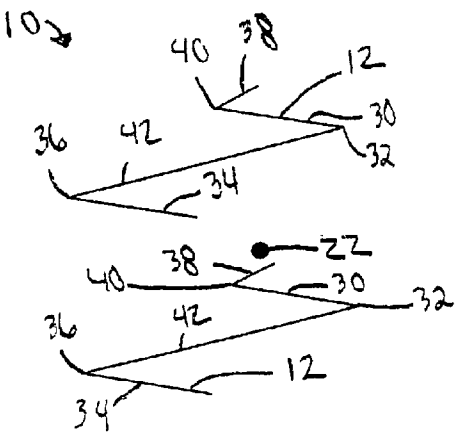
Figure 13:
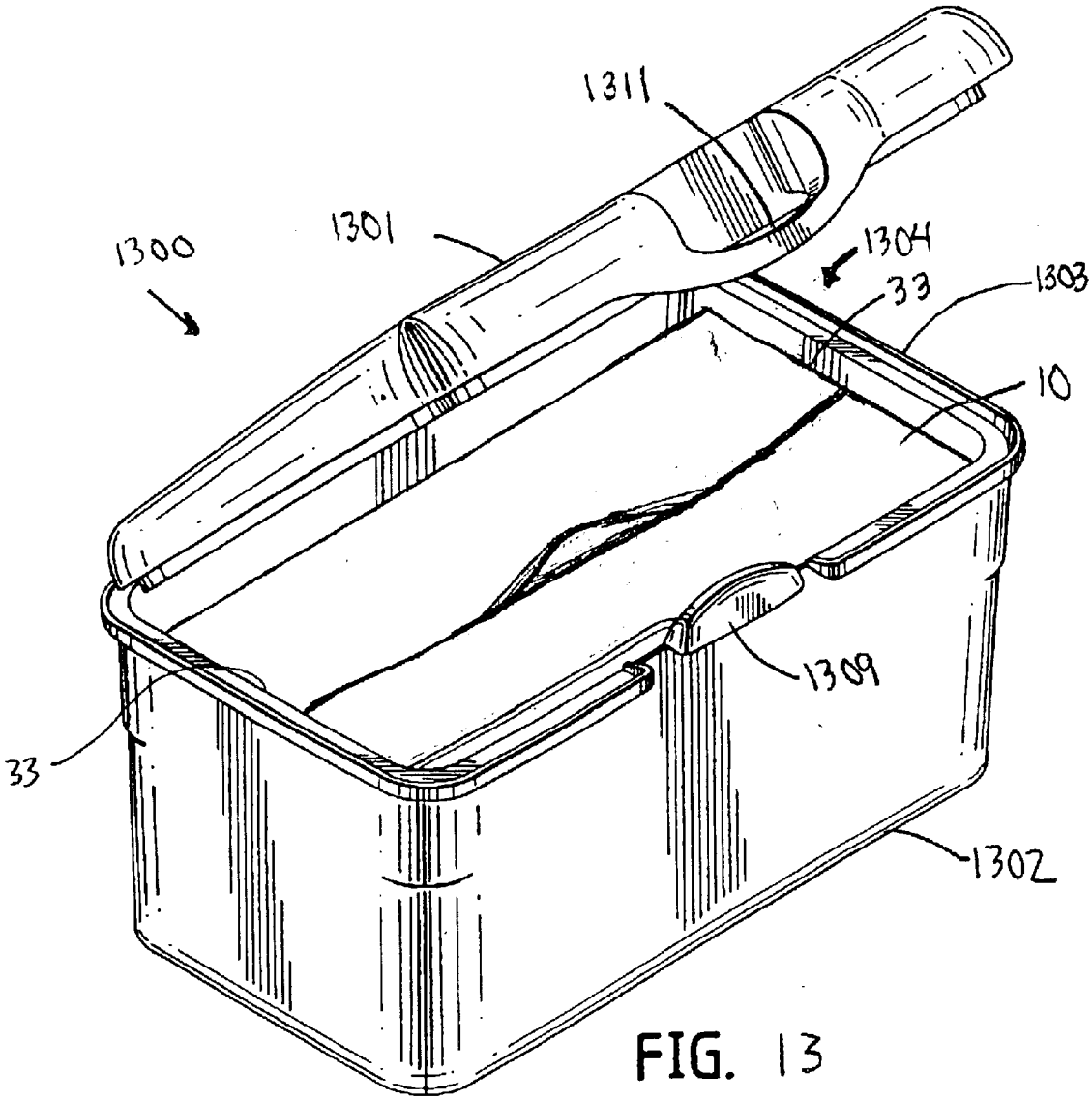
FIG. 13 representatively shows a perspective view of a type of rigid dispenser for use with wipes of the present invention, where a wipe is ready for reach-in dispensing and the dispenser is open.

As representatively illustrated throughout the figures, and for explanation now referring to FIGS. 1, 1A and 13 , the present invention provides a stack 10 of wipes 12 for use in a reach-in wipes dispenser 1300 having a dispensing opening 1303, and which can be resealable (e.g., by using a lid 1301). The stack 10 includes a plurality of wipes 12 separably joined to an adjacent wipe 12 to form a joint 11 therebetween, e.g., with adhesive 22, and the wipes 12 stacked upon each other. The circular shape of the symbol for adhesive 22 is not necessarily characteristic of the actual appearance of adhesive applied to the wipe 12, but is merely representative of the existence of such adhesive 22 in combination with the wipes. The location of the adhesive shown at the edge of the wipes is not the only location for adhesive 22. Adhesive 22 could be positioned at other locations across the surface of the wipes between the sides and edges.

FIGS. 1–8 are merely representative of the possible configurations for a plurality of wipes 12 which can include at least two wipes 12. For example, the plurality of wipes can include additional wipes, such as a repeating pattern of wipes 12 or different wipes, in a pattern or no pattern, and similar to wipes 12 in FIGS. 1–8, or configured differently, with or without adhesive, all as discussed herein. The plurality of wipes can have various folded configurations, including being unfolded. For example, each wipe 12 of the plurality of wipes can be folded upon itself at least once forming a leading portion 30 of the wipe before a first fold 32 and a trailing portion 34 of the wipe after a last fold 36. In some configurations, there may be only one fold, and thus the first fold would also be the last fold for determining the leading and trailing portions 30, 34, respectively, of the wipe 12 (e.g., FIGS. 3, 7 and 10). A leading edge 31 is formed between the sides 33 of the wipe and initiates the leading portion 30. A trailing edge 35 is formed between the sides 33 of the wipe and terminates the trailing portion 34. Depending on the number of fold for the wipe 12 in the stack 10, there may be a central portion 42 located between the first and last folds 32, 36 (e.g., FIGS. 1, 2, 4, 6, 8 and 9). Also, or alternatively, the wipes may have an initial fold 40 preceding the first fold 32 and a hinge flap 38 can be located between the initial fold 40 and the leading edge 31. In such a configuration, the leading portion generally includes the hinge flap 38. Some configurations provide the trailing portion of the top wipe at least partially overlaps (e.g., FIG. 1 does whereas FIG. 2 does not) or interfolds (e.g., FIGS. 7 and 8, at 13) the leading portion of the following wipe and these two wipes are separably joined at the overlap or interfold.

As a result of their work, the inventors have determined that particular separably joined relationships to form a joint 11 between the plurality of wipes 12 are better than others for overcoming some challenges to successively dispensing wipes in a reach-in format one at a time more successfully, and with ease in finding the leading edge of each wipe for successive dispensing occasions. For example, the inventors have determined that the separably joined relationship (e.g., adhesive 22, weakened line 26, or others) can join together the at least two wipes 12 of the plurality of wipes such that, for at least 50% of the wipes in the stack of wipes, dispensing a top wipe from the stack of wipes causes an adjacent following wipe to at least partially be drawn upwards towards and/or through the dispensing opening 1303, and the top wipe completely separates automatically from the following wipe at the joint 11 before the following wipe completely passes through the dispensing opening, and when the top wipe completely separates automatically from the following wipe the following wipe falls back towards the stack of wipes and is positioned within the dispenser 1300 and below the dispensing opening 1303. As concerns the requirement that at least 50% of the wipes in the stack of wipes perform as just discussed to completely separate automatically and fall back into the dispenser, the inventors have determined such is beneficial to achieve the desired reach-in dispensing more consistently and reliably throughout the stack of wipes, as compared to traditional pop-up dispensing systems which may fail (i.e., through wipe fall back) periodically but do not do so intentionally nor anywhere near at least 50% of the stack of wipes in such systems. Further in this regard, for the present invention, it can be more advantageous though not required, and in order of increasing advantage, for at least 60%, at least 70%, at least 80%, at least 90% or at least 95%, of the wipes in the stack of wipes to perform as just discussed to completely separate automatically at the joint and fall back into the dispenser after each wipe dispensing occasion.

The type of fall back that can occur with wipes of the invention ranges anywhere from a nominal stretch and retraction and/or nominal position change of the leading portion of the following wipe (i.e., with very little separation of the leading portion 30 of the following wipe from the adjacent portion of the following wipe upon which the leading portion rested before dispensing of the top wipe) to position change of the entire following wipe (i.e., causing the following wipe to completely unfold and be substantially drawn though the dispensing opening but not separating from the next following wipe such that when the top wipe completely separates from the following wipe the following wipe can fall back towards the stack of wipes and be positioned within the dispenser and below the dispensing opening, and where the fallen back following wipe likely does not, though it may, return to its folded configuration and rather bunches up on top of the stack to await the next dispensing occasion).

For wipes of the invention to be completely separated automatically, this means that the mere act of dispensing the top wipe from the dispenser causes the following wipe to eventually separate from the top wipe without any further intervention from the user during dispensing of the top wipe. For example, this can be accomplished, at least in part, due to a weight of the following wipe creating a force greater than a joining force of the separably joined relationship between the top wipe and the following wipe during dispensing of the top wipe (i.e., the downward force created by the weight of the following wipe, either a portion of the following wipe or the entire wipe, is greater than the force holding the top wipe and the following wipe together at their separably joined interface). Further, this can also include adhesion (due to being wet wipes, the wipes formation process, the basesheet material forming the wipes, and the like) forces. In any event, it is desired that the separably joined relationship be made so the force holding the top wipe and the following wipe together at their separably joined interface, e.g., the joint 11, is no greater than the adhesion of the adjacent wipes opposing surface areas plus the weight of the following wipe, and advantageously, only the weight of the leading portion of the following wipe and not the entire following wipe. In this way, then, during dispensing of the top wipe the following wipe will completely separate automatically for the desired reach-in dispensing for wipes of the invention.

The particular separably joined relationship strength needed between wipes may vary from wipe to wipe, as well as be dependent upon such factors as: the composition of the wipe material, the solution moistening the wipe (if any), handling of the wipe during manufacturing, the type of separably joined relationship between adjacent wipes, the folded or unfolded configuration of the wipes, the relationship of one wipe to any adjacent wipes, combinations of these, and the like. In light of the now taught ability to create a stack of wipes 10 that, for at least 50% of the wipes in the stack, intentionally fall back into the dispenser after each wipe is dispensed, one of ordinary skill in the art can determine the particular separably joined relationship strength needed for a particular stack of wipes.

For example, one such test to assist in determining the desired separably joined relationship, and strength of that relationship, is explained. This testing can be done, generally, under TAPPI standard procedures and conditions which would be applicable except as otherwise noted. A SINTECH™ Model # M4001 with a MTS 25 pound (11.4 Kg) load cell conventional test machine equipped with TestWorks™ 3.10 software for Windows, or comparable equipment, can be used. Testing is carried out according to ordinary procedures for using such equipment, and one can then determine the strength of the separably joined relationship between adjacent wipes (i.e., and the force to separate the wipes during dispensing as desired). Both the Sintech™ test machine and TestWorks™ software are available from MTS Corporation located at 1400 Technology Drive, Eden Prairie, Minn., USA. With this knowledge, then one can adjust the separably joined relationship as desired by conventional means, e.g., without limitation, vary one or more of the factors such as: the composition of the wipe material, the solution moistening the wipe (if any), handling of the wipe during manufacturing, the type of separably joined relationship between adjacent wipes, the folded or unfolded configuration of the wipes, the relationship of one wipe to any adjacent wipes, and the like; in order to obtain a stack of wipes of the invention.

Table 1 sets out data obtained from sample wipes made in accordance with the teachings of the invention and some conventionally available comparative sample wipes. Sample A includes baby wet wipes (made of composite elastic coform) that are currently commercially available from Kimberly-Clark Corporation of Neenah, Wis. under the tradename HUGGIES® Supreme Care (moistened with 330% add-on of HUGGIES® Supreme Care solution). Sample B includes wet wipes made into a stack of wipes from the same material as the baby wipes product currently available from Kimberly-Clark Corporation of Neenah, Wis. under the tradename HUGGIES® Supreme Care (moistened with 330% add-on of HUGGIES® Supreme Care solution), but modified to obtain pleat-like leading and trailing edges according to the teaching in the separate, but concurrently filed, U.S. patent application Ser. No. 10/318,827, entitled "WIPES WITH A PLEAT-LIKE ZONE ALONG THE LEADING EDGE PORTION" of inventors Scott Lange et al.

The sample B wipes were folded generally like that seen in FIGS. 1 and 1A and then separably joined together into a stack of wipes by using the hot melt adhesive commonly known as RT 2730 APAO, sold by Huntsman Polymers Corporation of 2502 South Grandview, Odessa, Tex. 79766. The adhesive was applied to the moistened coform with a PAM, Model 600 Spraymatic gun, manufactured by Division of BUEHNEN, West Germany which can be found in the United States at 2120 Gateway Blvd., Charlotte, N.C. 28266. The adhesive was applied in a swirl pattern near the middle of the wipe relative to the sides 33 (e.g., FIGS. 9A and 13) and within about 2 to 5 mm of the leading edge and covering a generally circular area of about 1 cm in diameter. The adhesive in the melt tank was maintained at about 375 degrees Fahrenheit and system pressures were adjusted to obtain the desired add-on through the nozzle. The amount of glue and spray pattern were controlled by adjusting the melt tank regulator and the pressure gauge to get the desired add-on amount of about 0.005 grams. Then, the second wipe was laid on top of the first wipe with adhesive thereon within about 3–4 seconds. A total of 32 wipes were separably joined together into a stack of wipes. About 3 to 4 minutes after the stack was prepared, a total weight of about 20 Kg was uniformly applied on the top of the stack for about 10 seconds. The wipes with adhesive applied thereon were placed in a sealed container, such as a plastic bag and allowed to rest for 1 to 3 days. The sealed container of wipes was then placed in a test lab and allowed to equilibrate to room temperature of about 20 degrees Celsius for about 24 hours, remaining sealed in the container until testing.

Figure 6:
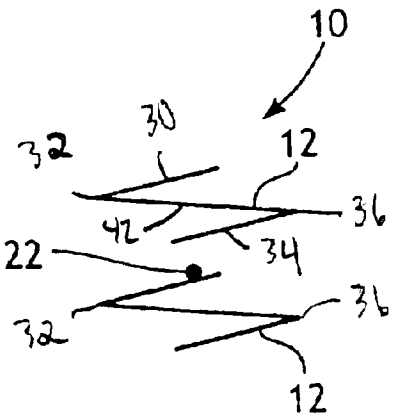
Figure 8:
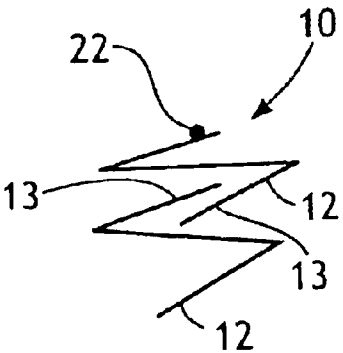
FIGS. 7–8 representatively show yet alternative configurations for separably joining together a plurality of wipes with at least two different separably joining relationships.
Figure 5:
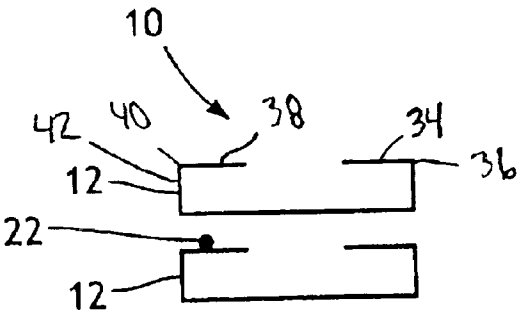
Figure 7:
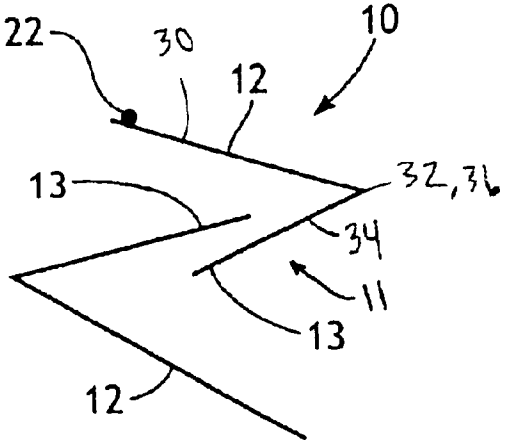

The sample C wipes were identical to the sample B wipes, except the sample C wipes were folded like that seen in FIG. 6. The sample D wipes were made of the same material as currently commercially available from Kimberly-Clark Corporation of Neenah, Wis. under the tradename HUGGIES® Natural Care (moistened with 330% add-on of HUGGIES® Natural Care solution). The wipes did not have pleat-like leading and trailing edges but were folded like that seen in FIGS. 1 and 1A. Then, the sample D wipes were joined together just like was done for the sample B wipes.

The samples were then dispensed from a dispenser like that seen in FIG. 13, and the rate of success recorded. A wipe was considered dispensed successfully if it had at least a portion of its leading edge readily separated from the adjacent surface of itself at least the thickness of the wipe, and if the leading wipe separated from the following wipe without fully withdrawing the following wipe through the dispensing opening (i.e., such that the following wipe would fall back into the dispenser and await the next desired dispensing occasion). It is noted that the first wipe in the stack is always a failure, and that an additional clip of wipes are used for weight purposes but not counted in the total number of wipes (i.e., the last clip of wipes are needed to provide a downward force to the last few wipes in the next to last clip of wipes to enable complete dispensing of the next to last clip of wipes in the stack of wipes).

TABLE 1

| | Total Number Of Wipes In Stack | Number of Wipes Dispensed Successfully | Average Angle 54 (FIG. 14) of Leading Portion of Wipe |
|---|---|---|---|
| Sample A | 32 (4 clips of 8 wipes) | 0 | 0° |
| Sample B | 32 (4 clips of 8 wipes) | 31 | 65.3° |
| Sample C | 32 (4 clips of 8 wipes) | 19 | 15.3° |
| Sample D | 40 (4 clips of 10 wipes) | 37 | 74.8° |

The inventors have developed other aspects that can be employed, as desired, to favorably impact the separably joined relationship between wipes 12. For example, adhesive 22 can be substantially located at the center leading edge of the wipes, and even, extending from about a first side 33 of the wipes to about a second side 33 of the wipes 12 if a weak enough adhesive pattern is used. As another example, adhesive 22 can be applied, at least in part, in a curved pattern. Yet further, for example, the adhesive can be applied, at least in part, in a swirl pattern. Still further, for example, a weakened line pattern can join the wipes 12 together over an entire length of the wipes when a weak enough pattern is used (e.g., FIG. 9) or an alternate partial weakened line pattern could be used depending on desired strength for the weakened line (e.g., FIG. 10A).

The inventors have developed still another aspect that can be employed, as desired, to favorably impact the adhesive relationship between a plurality of wipes 12. For example, adhesive 22 can be added-on to the wipes 12 anywhere across the top surface portion of the wipe that will directly oppose the adjacent wipe laid on top for adhesive joining thereto (e.g., anywhere across the top surface portion seen in FIG. 1A). More particularly, the inventors have discovered that the add-on location across the top surface portion of the wipes can advantageously be located relative to the leading edge 31, in order of increasing advantage, within 75% of the leading edge, within 50% of the leading edge, within 25% of the leading edge, or within 10% of the leading edge. Still more particularly, the inventors have discovered that the add-on location across the top surface portion of the wipes can advantageously be located relative to the exact center of the wipes relative to the sides 33 of the wipe, in order of increasing advantage, within 50% of the exact center, within 25% of the exact center, or within 10% of the exact center.

The inventors have developed other aspects that can be employed, as desired, to favorably provide enhanced reach-in dispensing. For example, the trailing portion of the following wipe can be made to substantially stay undisplaced by dispensing of the top wipe. It can be further advantageous to provide the stack of wipes with separably joined relationships such that each top wipe only draws at most the leading portion (i.e., and mainly the hinge flap if there is one) towards the dispensing opening upon the top wipe completely separating automatically from the following wipe. With this later aspect, it is more likely that the leading edge will be in a stand-up position (discussed further below) and/or easy to distinguish from the rest of the following wipe because substantially only the leading portion will be loosened from the stack of wipes. One way to accomplish such a feature is to adjust the separably joined relationship as needed based on the teaching herein. Another example for enhancing reach-in dispensing of the invention is by providing the stack of wipes where, for at least 50% of the wipes in the stack of wipe, the leading portion 30 of the following wipe stays below the dispensing opening 1303 during the time when the top wipe is being dispensed and until the top wipe is completely separated automatically from the following wipe and the following wipe then becomes the top wipe in the stack of wipes. As still another example for enhanced dispensing, the leading portion 30 can have an edge portion 44 (FIG. 1A) having a surface texture different than a surface texture of a remainder of the leading portion of the wipe. One way to accomplish such a feature is by forming a pleat-like edge as taught in the concurrently filed application Ser. No. 10/318,827 discussed herein.

Figure 14:
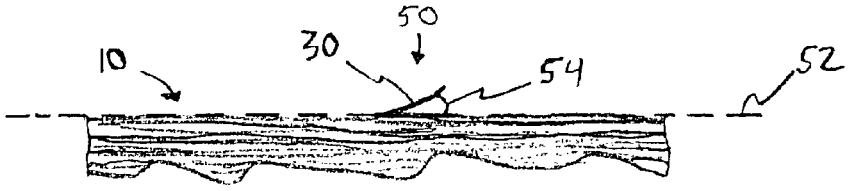
FIG. 14 representatively shows a side view of a portion of a stack of wipes, where a top wipe is ready for dispensing with the leading portion in a stand-up position.

Referring to FIG. 14, still another example for enhancing reach-in dispensing of the invention is by providing a stack of wipes where a portion of the leading portion 30 of the following wipe is left in a stand-up position for the time period immediately after complete dispensing of the top wipe and for at least one minute as long as the wipes remaining in the dispenser are substantially undisturbed by an outside force (i.e., movement of the wipes dispenser in any way). Further in this regard, and in order of increasing advantage, the stand-up position can define an angle 54 at least about 5 degrees, at least about 15 degrees, at least about 30 degrees or at least about 45 degrees, above a horizontal plane 52 defined coextensive with a top surface of the stack of wipes.

The stack 10 of wipes 12 of the present invention, e.g., wet wipes, can be arranged in a package or dispenser in any manner which provides convenient and reliable one at a time dispensing in accordance with the invention, and advantageously, also which assists the wet wipes in not becoming contaminated (i.e., from an external environment) or overly dry (i.e., if wet wipes). For example, the wet wipes can be arranged in a dispenser or package as a plurality of individual sheets arranged in a stacked configuration to provide a stack of wet wipes which may or may not be individually folded. The wet wipes can be individual wet wipes which are folded in a c-fold configuration (e.g., FIG. 5), z-fold configuration (e.g., FIG. 4), backward z-fold configuration (e.g., FIG. 6), modified z-fold configuration (e.g., FIGS. 1–2), v-fold configuration (e.g., FIG. 3) or other non-interfolded configurations as are known to those skilled in the art. For such a "non-interfolded" wipe, each wipe is folded onto itself with no portion of a wipe being positioned underneath any portion of the adjacent wipe(s). Alternatively, the individual wet wipes can be interfolded, such that the trailing end of a preceding wipe in the stacked configuration laps under the leading end of the following wipe (e.g., FIGS. 7–8). Such a plurality of interfolded wipes could then be joined to another wipe (or other wipes) with the same or a different separably joined relationship (e.g., adhesive 22, as in FIGS. 7–8). In each of these non-interfolded and interfolded configurations, the leading end edge of the following wet wipe is loosened from the stack by the trailing end edge of the leading wet wipe as the leading wet wipe is removed by the user from the dispenser or package. These configurations for wipes, as well as those discussed above, can be provided by means known to those skilled in the art.

Figure 9A:
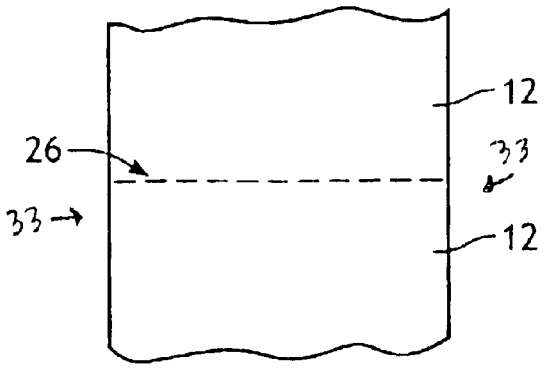
FIG. 9A representatively shows a schematic top view of a portion of the wipes of FIG. 9.
Figure 10A:
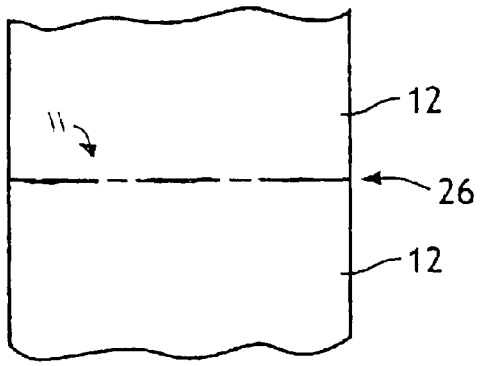
FIG. 10A representatively shows a schematic top view of a portion of the wipes of FIG. 10.
Figure 9:
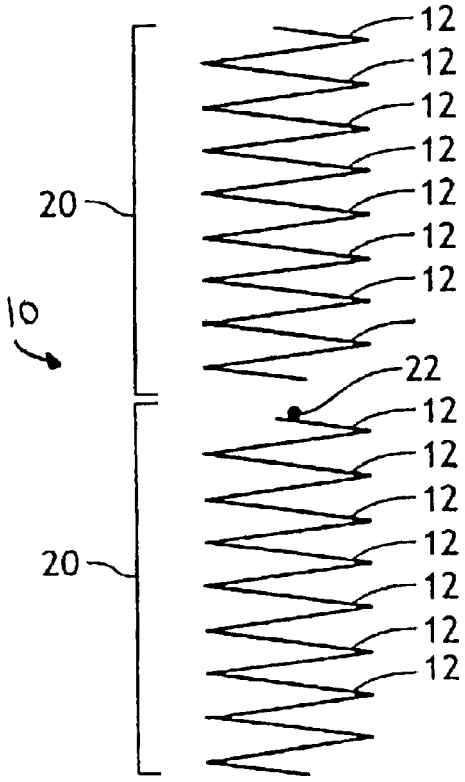
FIG. 9 representatively shows clips of a plurality of wipes, each wipe in the clip separably joined to another, and the clips of wipes separably joined to each other.
Figure 10:
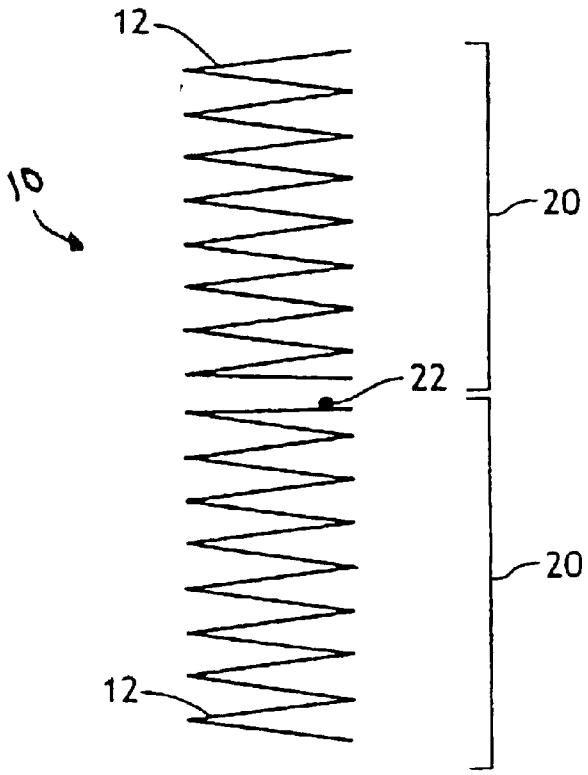
FIG. 10 representatively shows an alternative configuration for clips of a plurality of wipes, each wipe in the clip separably joined to another, and the clips of wipes separably joined to each other.

FIGS. 9 and 10 schematically show still additional configurations for wipes 12 of the invention. The wipe "clips" include a plurality of individual wipes 12, which are stacked as a continuous web of weakened line connected wipes which are folded in an accordion-like stacked configuration, with the top wipe of the clip having adhesive 22 for joining to another wipe or clip of wipes. Alternatively, an interfolded relationship could be used to connect adjacent clips of wipes, or wipes within the clip. Particular fold configurations the same as, similar to or different from, those here can be provided by means known to those skilled in the art. The wipes 12 in FIG. 10 are also a plurality of individual wipes like those in FIG. 9, although each wipe is not separately numbered as in FIG. 9. In this regard, the making of each such clip of wipes 12 is disclosed in a US patent application filed on May 31, 2001 and entitled, "Stack Of Fan Folded Material And Combinations Thereof" of inventor Gerald K Sosalla, U.S. Ser. No. 09/871,019 assigned to the same Assignee of this application.

Referring to FIGS. 9A and 10A, a top view of a portion of the wipes in the clips in an unfolded state shows the individual wipes of the dips can be separably joined together along weakened lines 26, such as lines of perforations, to ensure that the trailing wipe is in position for grasping by the user after the leading wipe is removed. For example, the wipes can be provided by a continuous web of material which has a series of weakened lines extending across the width of the web, with a pattern like that seen in FIGS. 9A or 10A or other desired patterns. The portion of the web of material between successive weakened lines provides each individual wipe. Additionally, the weakened lines can be provided by means known to those skilled in the art such as perforations, indentations or cuts in the web of material. After the weakened lines have been incorporated into the web of material, the web can then be arranged in a stacked configuration for easy insertion into a dispenser or package.

Referring generally to the figures now, the plurality of wipes, such as a stack of wipes 12, can include any suitable number of individual wipes depending upon the desired packaging and end use. For example, the plurality 10 can be configured to include a stack of wet wipes which can include at least about 5 wet wipes and desirably from about 16 to about 320 individual wet wipes, and more desirably from about 32 to about 160 wet wipes. The size and shape of the stack of wipes 12 is dependent upon the size and shape of the package or dispenser and vice versa. For example, the length of an assembled stack of wipes can be about 190 mm, with a height of about 90 mm and a width of about 100 mm.

Each wipe is generally rectangular in shape and defines a pair of opposite side edges 33 and a pair of opposite end edges 31, 35 which can be referred to as a leading end edge 31 and a trailing end edge 35. Each wipe defines an unfolded width between sides 33 and an unfolded length between edges 31, 35. The wipe can have any suitable unfolded width and length. For example, a wet wipe can have an unfolded length of from about 2.0 to about 80.0 centimeters and desirably from about 10.0 to about 26.0 centimeters and an unfolded width of from about 2.0 to about 80.0 centimeters and desirably from about 10.0 to about 45.0 centimeters.

Materials suitable for the wipes of the present invention are well known to those skilled in the art. The wipes can be made from any material suitable for use as a wipe, including nonwoven webs, tissue materials, paper materials, high wet-strength tissue and the like and can comprise synthetic or natural fibers or combinations thereof. The wet wipes can have a dry basis weight of from about to about 120 grams per square meter and desirably from about 40 to about 90 grams per square meter.

In a particular aspect, the wet wipes can comprise coform, e.g., a coform basesheet of polymeric microfibers and cellulosic fibers having a basis weight of from about 60 to about 100 grams per square meter and desirably about 80–85 grams per square meter. Typically, such coform basesheets comprise a gas-formed matrix of thermoplastic polymeric meltblown microfibers, such as, for example, polypropylene microfibers, and cellulosic fibers, such as, for example, wood pulp fibers. The relative percentages of the polymeric microfibers and cellulosic fibers in the coform basesheet can vary over a wide range depending on the desired characteristics of the wet wipes. For example, the coform basesheet can comprise from about 20 to about 100 weight percent, desirably from about 20 to about 60 weight percent, and more desirably from about 30 to about 40 weight percent of polymeric microfibers based on the dry weight of the coform basesheet being used to provide the wet wipes. An example of such a coform basesheet for use in the present invention is found in the baby wipes product presently sold by Kimberly-Clark Corporation and known as HUGGIES® Natural Care or found in the baby wipes product presently sold by Kimberly-Clark Corporation and known as HUGGIES® Supreme Care.

In another aspect of the invention, wipes 12 can contain a liquid which can be any liquid or solution which can be absorbed into the wipes (e.g., water based, oil based, others), thus making them wet wipes. The wipes can be moistened at any time before the wipes are actually used by the consumer. Preferably they are moistened some time during the manufacturing process before or contemporaneous with the plurality of wipes being sealed in a dispenser or other packaging for next use by a product user. The liquid contained within the wet wipes can include any suitable components which provide the desired wiping properties. For example, the components can include water, emollients, surfactants, preservatives, chelating agents, pH buffers, fragrances or combinations thereof. The liquid can also contain lotions, ointments and/or medicaments. An example of such a liquid for use in the present invention is found in the baby wipes product presently sold by Kimberly-Clark Corporation and known as HUGGIES® Natural Care.

The amount of liquid or solution contained within each wet wipe can vary depending upon the type of material being used to provide the wet wipe, the type of liquid or solution being used, the type of container being used to store the stack of wet wipes, and the desired end use of the wet wipe. In a particular aspect wherein the wet wipe is made from a coform material comprising from about 30 to about 40 weight percent polymeric microfibers based on the dry weight of the wipe, the amount of liquid contained within the wet wipe is from about 250 to about 350 weight percent and desirably about 330 weight percent based on the dry weight of the wet wipe. If the amount of liquid is less than the above-identified range, the wet wipes can be too dry and may not adequately perform depending on the desired task. If the amount of liquid is greater than the above-identified range, the wet wipes can be over saturated and soggy and the liquid can pool in the bottom of the container, as well as possibly contribute to problems with the adhesive 22 sticking to the surface of wipes 12.

Figure 11:
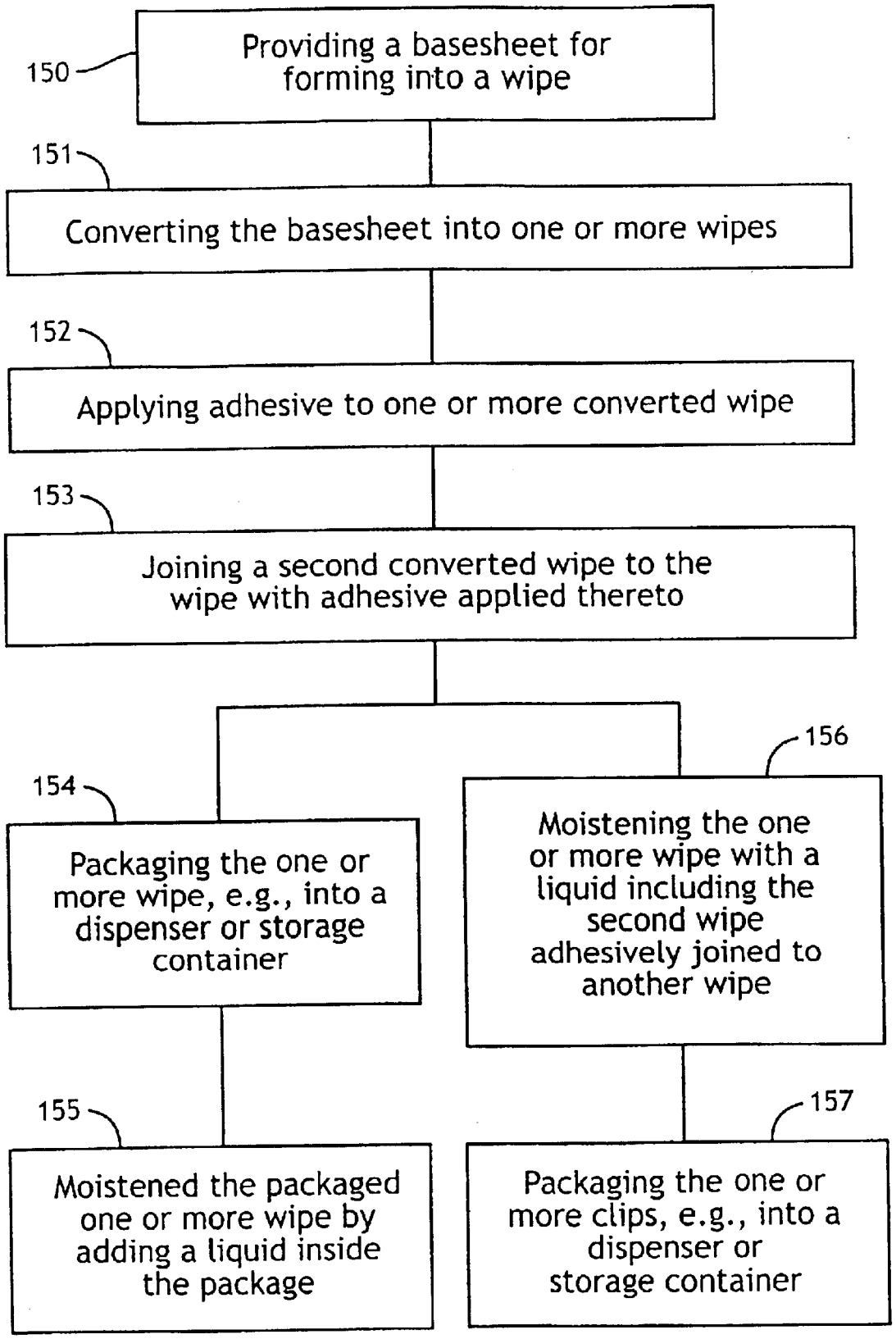
FIG. 11 representatively shows a schematic diagram for making wipes of the invention.
Figure 12:
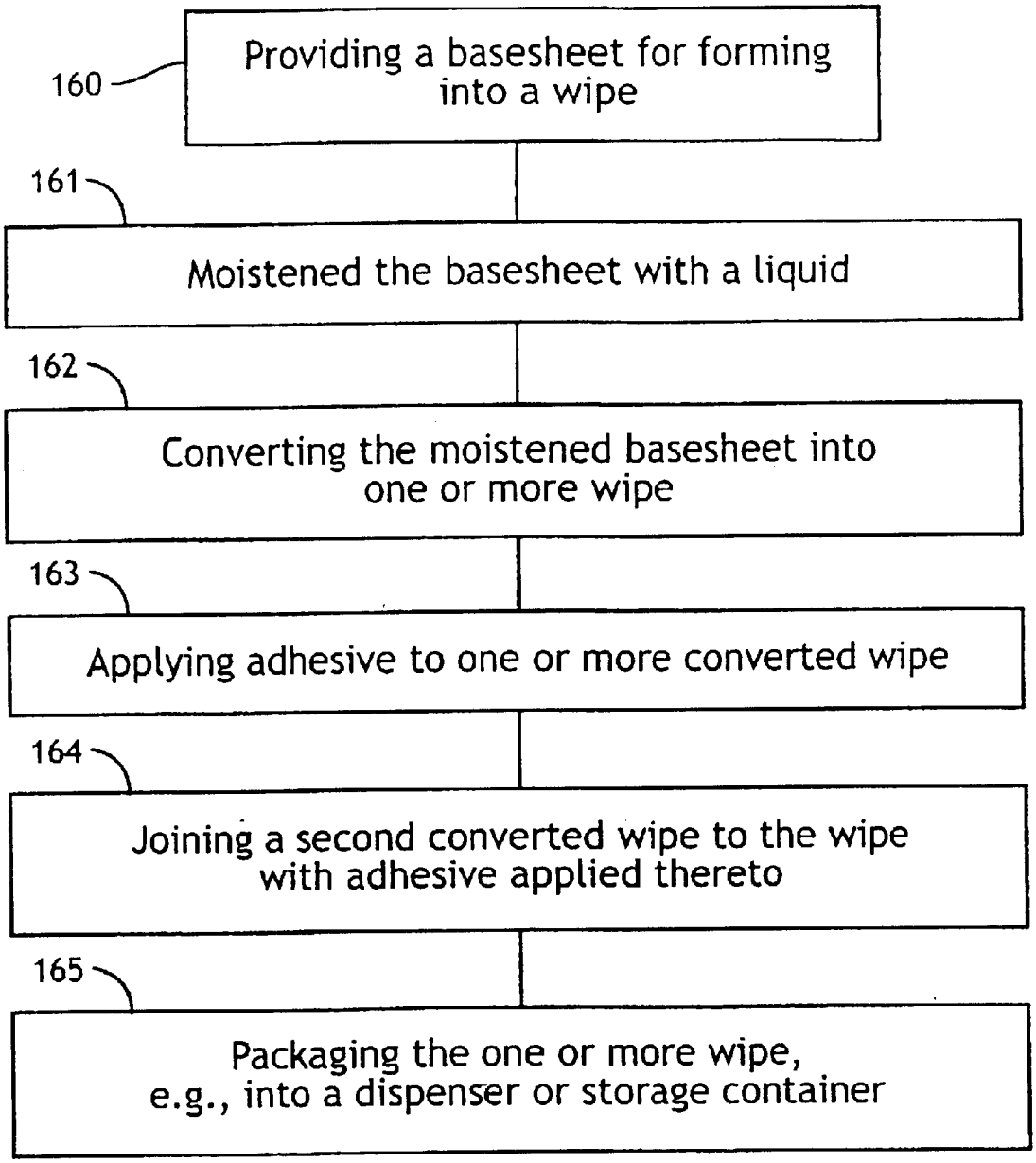
FIG. 12 representatively shows a schematic diagram for alternately making wipes of the invention.

FIGS. 11 and 12 schematically show representative steps for making a stack 10 of wipes 12 of the present invention. Each of these steps can be specifically performed according to the teachings herein or as would be known to one skilled in the art, depending on particular circumstances in combination with the teaching herein. These steps are described as follows, generally in the following order though not required, but rather, dependent upon the circumstances. First steps 150 and 160 are the same, namely, providing a base sheet for forming into a wipe. From there, the steps can diverge. After step 150 is step 151 of converting the basesheet into one or more wipes. This usually includes forming several individual wipes from a large base sheet of wipe material. Near simultaneously with the forming of individual wipes, if the wipes are to be folded or interfolded with another wipe such as to form a clip of wipes, this usually occurs now. Next, adhesive can be applied to the wipes in step 152. This occurs either on an individual wipe basis such as when the wipes are not interfolded and another separably joining together means is not desired, or to the leading wipe within a clip of wipes when two of more wipes are formed as a clip of wipes separable joined together. Next, the second wipe, either an individual second wipe or last wipe of the clip of wipes placed on top of the first wipe of the below clip of wipes, is joined to the first wipe with adhesive applied thereto, in step 153. As used herein "applying" means any way to get adhesive onto the at least two wipes that are adhesively joined together, which can include without limitation, spraying, rolling, squirting, drooling, painting, coating and/or printing. This also includes getting the adhesive onto the two wipes in any order (as between the two wipes being joined by adhesive) or simultaneously. Next, the wipes or stack of wipes are ready for their final steps of 154 to 157 including packaging and moistening, in either order as shown. The wipes are now ready for consumption by a user.

FIG. 12 shows an alternate set of steps for making the wipes of the invention. The principal difference is that here, the basesheet is moistened in step 161 in advance of applying adhesive in step 163. Although converting in step 162 is also shown to follow moistening step 161, steps 161 and 162 can be reversed and they can occur near simultaneously, all dependent upon how many sub-steps are employed in the converting step 162. Such sub-steps are known to those of skill in the art and are often driven by economics or equipment to obtain a desired fold or interfolding of the plurality of wipes.

Otherwise, steps 163 to 165 are analogous to above described steps 152, 153 and 154/157 respectively.

FIGS. 11 and 12, in combination with the teachings herein, demonstrate that the adhesive can be applied to the wipes before or after the wipes are moistened with the liquid to become wet wipes. However, desirably the wipes can be moistened before adhesive is applied to provide a more uniformly moistened product and/or depending on manufacturing desires. In this regard, although a variety of adhesives are believed to be usable to practice the invention, when adhesive is applied before moistening certain adhesives work better than others and certain adhesives work better on certain types of basesheets than others. Some adhesives are hot melt adhesives such as those known as H2800, H2727A and H2525A, all styrenic block copolymers, and all of Bostik Findley Inc. of 11320 Watertown Plank Road, Wauwatosa, Wis. 53226. Others include RT2715 and RT2730, each an Amorphous Poly Alpha Olefin (APAO), and each available from Huntsman as noted previously. Finally, it should also be understood that some or all of the features of the invention described can be combined, and particular values within ranges selected, as would be known to do to one of ordinary skill in the art based on the teachings of the invention herein.

FIG. 13 shows a representative rigid plastic container for storing and dispensing wipes of the invention. Other examples of rigid containers suitable for use with the present invention are found in the product presently sold by Kimberly-Clark Corporation and known as HUGGIES® Natural Care baby wipes or HUGGIES® Supreme Care baby wipes. The dispenser 1300 includes a lid 1301 hingedly attached to a base 1302, the base including a cavity 1304 for storing the wipes. The dispensing opening is coextensive with the inside perimeter of the container, and is through which individual wet wipes are removed from the container. The lid is secured in a closed position by a suitable latching mechanism, in which a protrusion 1309 in the front lip of the base is engaged by an opening 1311 in the front lip of the lid. In use, the lid 1301 is opened and then access to the cavity 1304 is gained. The user then passes his or her hand, etc. through the container opening to grab the first wipe in the stack of wipes. Once the user grabs the wipe, it can then pass through the opening as the user pulls it up. The following wipe will separate from the leading wipe as discussed above for wipes of the invention, i.e., leaving the leading edge of the following wipe in position for next dispensing when desired. After the desired number of wipes are taken, the lid can be closed resealing the container.

An example of non-rigid containers for use with the present invention is found in the baby wipes refill packages presently sold by Kimberly-Clark Corporation and known as HUGGIES® Natural Care or HUGGIES® Supreme Care resealable refill packs. Generally, use of such non-rigid dispensers for dispensing wipes of the invention is similar to that for container 1300, except when due to obvious structural difference.

More particularly, for example, the invention is a method for dispensing a stack 10 of wipes 12 from a resealable reach-in wipes dispenser 1300 having a dispensing opening 1303. The method includes, in no particular order, though it can be advantageous to consider the following order, the following steps. First, a user unseals the reach-in wipes dispenser to gain access to a plurality of wipes 12 stacked upon each other to form the stack of wipes. Each wipe in the stack of wipes can be folded upon itself at least once and each wipe is separably joined to an adjacent wipe. Also, the wipes can be wet wipes. Next, the user locates a leading portion 30 of a top wipe and withdraws the leading portion through the dispensing opening 1303. Third, in this act of withdrawing the top wipe, the top wipe at least partially unfolds as the leading portion 30 is withdrawn through the dispensing opening. Then, for at least 50% of the wipes in the stack of wipes, the act of withdrawing the top wipe also draws upwards at least a portion of the following wipe towards and/or through the dispensing opening so that the top wipe completely separates automatically from the following wipe before the following wipe completely passes through the dispensing opening and when the top wipe completely separates automatically from the following wipe the following wipe falls back towards the stack 10 of wipes 12 and is positioned within the dispenser 1300 and below the dispensing opening 1303. Fourth, the user seals the reach-in wipes dispenser, i.e., dosing the lid 1301 upon the base 1302. The method can also include, advantageously though not required, the following steps. During the dispensing of wipes 12 from the stack 10, for at least 50% of the wipes in the stack of wipes, maintaining the leading portion of the following wipe below the dispensing opening 1303 during the time when the top wipe is being dispensed and until the top wipe is completely separated automatically from the succeeding wipe. Additionally or alternatively, dispensing can include maintaining the trailing portion of the following wipe substantially undisplaced by dispensing of the top wipe. Still additionally or alternatively, dispensing can include positioning a portion of the leading portion 30 of the following wipe in a stand-up position for the time period immediately after complete dispensing of the top wipe and for at least one minute as long as the wipes remaining in the dispenser are substantially undisturbed by an outside force. Yet additionally or alternatively, though not specifically mentioned here again, other steps can be completed based on the teachings herein, as desired.

All publications, patents, and patent documents cited in the specification are incorporated by reference herein, as though individually incorporated by reference. In the case of any inconsistencies, the present disclosure, including any definitions herein, will prevail. While the invention has been described in detail with respect to the specific aspects thereof, it will be appreciated that those skilled in the art, upon attaining an understanding of the foregoing, may readily conceive of alterations to, variations of, and equivalents to these aspects which fall within the spirit and scope of the present invention, which should be assessed accordingly to that of the appended claims.

What is claimed is:

1. A stack of wipes for use in a reach-in wipes dispenser having a dispensing opening, comprising:

a plurality of wipes stacked upon each other;

each wipe separably joined to an adjacent wipe to form a joint therebetween; and wherein, for at least 50% of the wipes in the stack of wipes, dispensing a top wipe from the stack of wipes causes an adjacent following wipe to at least partially be drawn upwards towards and/or through the dispensing opening and the top wipe completely separates automatically from the following wipe at the joint before the following wipe completely passes through the dispensing opening and when the top wipe completely separates automatically from the following wipe the following wipe falls back towards the stack of wipes and is positioned within the dispenser and below the dispensing opening.

2. The stack of claim 1 wherein each wipe of the plurality of wipes is folded upon itself at least once forming a leading portion of the wipe before a first fold and a trailing portion of the wipe after a last fold.

3. The stack of claim 2 wherein the trailing portion of the following wipe substantially stays undisplaced by dispensing of the top wipe.

4. The stack of claim 2 wherein, for at least 50% of the wipes in the stack of wipes, the leading portion of the following wipe stays below the dispensing opening during the time when the top wipe is being dispensed and until the top wipe is completely separated automatically from the following wipe and the following wipe then becomes the top wipe in the stack of wipes.

5. The stack of claim 1 wherein automatically comprises, at least in part, a weight of the following wipe creating a force greater than a joining force of the separably joined relationship between the top wipe and the following wipe during dispensing of the top wipe.

6. The stack of claim 2 wherein a portion of the leading portion of the following wipe is left in a stand-up position for the time period immediately after complete dispensing of the top wipe and for at least one minute as long as the wipes remaining in the dispenser are substantially undisturbed by an outside force.

7. The stack of claim 6 wherein the stand-up position defines an angle at least about 5 degrees above a horizontal plane defined coextensive with a top surface of the stack of wipes.

8. The stack of claim 6 wherein the stand-up position defines an angle at least about 15 degrees above a horizontal plane defined coextensive with a top surface of the stack of wipes.

9. The stack of claim 6 wherein the stand-up position defines an angle at least about 30 degrees above a horizontal plane defined coextensive with a top surface of the stack of wipes.

10. The stack of claim 6 wherein the stand-up position defines an angle at least about 45 degrees above a horizontal plane defined coextensive with a top surface of the stack of wipes.

11. The stack of claim 2 wherein the leading portion comprises an edge portion having a surface texture different than a surface texture of a remainder of the leading portion of the wipe.

12. The stack of claim 2 wherein the trailing portion of the top wipe at least partially overlaps or interfolds the leading portion of the following wipe and these two wipes are separably joined at the overlap or interfold.

13. The stack of claim 2 wherein the plurality of wipes are wet wipes.

14. A stack of wipes for use in a resealable reach-in wipes dispenser having a dispensing opening, comprising:

a plurality of wipes stacked upon each other;

each wipe of the plurality of wipes being separably joined to an adjacent wipe to form a joint therebetween and each wipe being folded upon itself at least once forming a leading portion of the wipe before a first fold and a trailing portion of the wipe after a last fold;

wherein, for at least 50% of the wipes in the stack of wipes, dispensing a top wipe from the stack of wipes causes an adjacent following wipe to at least partially be drawn upwards towards and/or through the dispensing opening and the top wipe completely separates automatically from the following wipe at the joint before the following wipe completely passes through the dispensing opening and when the top wipe completely separates automatically from the following wipe the following wipe falls back towards the stack of wipes and is positioned within the dispenser and below the dispensing opening; and wherein, for at least 50% of the wipes in the stack of wipes, the leading portion of the following wipe stays below the dispensing opening during the time when the top wipe is being dispensed and until the top wipe is completely separated automatically from the following wipe and the following wipe then becomes the top wipe in the stack of wipes.

15. The stack of claim 14 wherein the trailing portion of the following wipe substantially stays undisplaced by dispensing of the top wipe.

16. The stack of claim 14 wherein automatically comprises, at least in part, a weight of the following wipe creating a force greater than a joining force of the separably joined relationship between the top wipe and the following wipe during dispensing of the top wipe.

17. The stack of claim 14 wherein a portion of the leading portion of the following wipe is left in a stand-up position for the time period immediately after complete dispensing of the top wipe and for at least one minute as long as the wipes remaining in the dispenser are substantially undisturbed by an outside force.

18. The stack of claim 17 wherein the stand-up position defines an angle at least about 5 degrees above a horizontal plane defined coextensive with a top surface of the stack of wipes.

19. The stack of claim 17 wherein the stand-up position defines an angle at least about 30 degrees above a horizontal plane defined coextensive with a top surface of the stack of wipes.

20. The stack of claim 17 wherein each wipe comprises a hinge flap joined along an initial fold to the leading portion and the leading portion of the following wipe left in a stand-up position is a portion of the hinge flap.

21. The stack of claim 20 wherein each wipe further comprises the leading portion joined along the first fold to a central portion and the central portion joined along the last fold to the trailing portion.

22. The stack of claim 14 wherein the leading portion comprises an edge portion having a surface texture different than a surface texture of a remainder of the leading portion of the wipe.

23. The stack of claim 14 wherein the trailing portion of the top wipe at least partially overlaps or interfolds the leading portion of the following wipe and these two wipes are separably joined at the overlap or interfold.

24. The stack of claim 14 wherein the plurality of wipes are wet wipes.

25. A method for dispensing a stack of wet wipes from a resealable reach-in wipes dispenser having a dispensing opening, comprising:

unsealing the reach-in wipes dispenser to gain access to a plurality of wipes stacked upon each other to form the stack of wipes, each wipe in the stack of wipes folded upon itself at least once and each wipe separably joined to an adjacent wipe to form a joint therebetween and each wipe being a wet wipe;

locating a leading portion of a top wipe and withdrawing the leading portion through the dispensing opening;

at least partially unfolding the top wipe as the leading portion is withdrawn through the dispensing opening;

for at least 50% of the wipes in the stack of wipes, drawing upwards at least a portion of the following wipe towards and/or through the dispensing opening wherein the top wipe completely separates automatically from the following wipe at the joint before the following wipe completely passes through the dispensing opening such that when the top wipe completely separates automatically from the following wipe the following wipe falls back towards the stack of wipes and is positioned within the dispenser and below the dispensing opening; and sealing the reach-in wipes dispenser.

26. The method of claim 25 further comprising, for at least 50% of the wipes in the stack of wipes, maintaining the leading portion of the following wipe below the dispensing opening during the time when the top wipe is being dispensed and until the top wipe is completely separated automatically from the succeeding wipe.

27. The method of claim 25 further comprising maintaining the trailing portion of the following wipe substantially undisplaced by dispensing of the top wipe.

28. The method of claim 25 further comprising positioning a portion of the leading portion of the following wipe in a stand-up position for the time period immediately after complete dispensing of the top wipe and for at least one minute as long as the wipes remaining in the dispenser are substantially undisturbed by an outside force.

* * * * *